US009388714B2

(12) United States Patent
Janowiak

(10) Patent No.: US 9,388,714 B2
(45) Date of Patent: Jul. 12, 2016

(54) BALL PLUNGER FOR USE IN A HYDRAULIC LASH ADJUSTER AND METHOD OF MAKING SAME

(75) Inventor: Gary Janowiak, Saginaw, MI (US)

(73) Assignee: Eaton Corporation, Cleveland, OH (US)

( * ) Notice: Subject to any disclaimer, the term of this patent is extended or adjusted under 35 U.S.C. 154(b) by 210 days.

(21) Appl. No.: 13/484,701

(22) Filed: May 31, 2012

(65) Prior Publication Data

US 2012/0234067 A1 Sep. 20, 2012

Related U.S. Application Data

(62) Division of application No. 12/235,919, filed on Sep. 23, 2008, now abandoned.

(51) Int. Cl.

| | |
|---|---|
| ***B23K 23/00*** | (2006.01) |
| ***B21J 5/02*** | (2006.01) |
| ***B21J 13/00*** | (2006.01) |
| ***F01L 1/18*** | (2006.01) |

(Continued)

(52) U.S. Cl.

CPC ..... *F01L 1/2405* (2013.01); *F01L 1/14* (2013.01); *Y10T 29/493* (2015.01); *Y10T 29/49298* (2015.01); *Y10T 29/49304* (2015.01); *Y10T 29/49311* (2015.01); *Y10T 29/49313* (2015.01); *Y10T 29/49995* (2015.01)

(58) Field of Classification Search

CPC ..... F01L 1/2405; F01L 1/20; F01L 1/22; F01L 1/24; Y10T 29/49304; Y10T 29/49995; Y10T 29/49298; Y10T 29/493; Y10T 29/49311; Y10T 29/49313; B23K 23/00; B21J 13/00

USPC ..... 29/557, 888.43, 888.4, 888.44, 29/888.451, 888.452; 72/354.6, 355.2, 72/355.6, 358, 359, 370.1; 123/90.43, 123/90.45, 90.46, 90.55

See application file for complete search history.

(56) References Cited

U.S. PATENT DOCUMENTS

| | | | |
|---|---|---|---|
| 2,681,644 | A | 6/1954 | Purchas, Jr. et al. |
| 3,054,177 | A | 9/1962 | Duhamel |

(Continued)

FOREIGN PATENT DOCUMENTS

| | | |
|---|---|---|
| CN | 201593451 | 9/2010 |
| DE | 3935027 A | 4/1991 |

(Continued)

OTHER PUBLICATIONS

Chinese Office Action for Chinese Patent Application No. 200910176624.8 dated Feb. 1, 2013 and English translation thereof.

(Continued)

*Primary Examiner* — David Bryant
*Assistant Examiner* — Darrell C Ford
(74) *Attorney, Agent, or Firm* — Remarck Law Group PLC

(57) ABSTRACT

A method of cold-forming a ball plunger blank includes providing a slug having first and second ends and backward extruding the slug at its first end to form a cavity that is defined by a wall. The method further includes forming a generally ball-shaped outer surface at the second end of the slug to final dimensions. The method also includes upsetting at least a portion of the wall to form a shoulder that at least partially closes the cavity and defines a ball seat surface to final dimensions.

24 Claims, 5 Drawing Sheets

(51) Int. Cl.
*F01L 1/24* (2006.01)
*F01L 1/14* (2006.01)

(56) References Cited

U.S. PATENT DOCUMENTS

| | | | | |
|---|---|---|---|---|
| 3,644,973 | A * | 2/1972 | Abe | 29/898.052 |
| 3,910,091 | A * | 10/1975 | Samanta | 72/256 |
| 4,004,558 | A | 1/1977 | Scheibe | |
| 4,083,334 | A | 4/1978 | Roncon | |
| 4,098,240 | A | 7/1978 | Abell, Jr. | |
| 4,227,495 | A | 10/1980 | Krieg | |
| 4,249,408 | A * | 2/1981 | Lovell | 72/256 |
| 4,319,934 | A * | 3/1982 | Henning | 148/635 |
| 4,322,256 | A * | 3/1982 | Henning | 148/330 |
| 4,367,701 | A | 1/1983 | Buente | |
| 4,416,141 | A * | 11/1983 | Nippert | 72/345 |
| 4,463,714 | A | 8/1984 | Nakamura | |
| 4,575,343 | A * | 3/1986 | Kin et al. | 445/7 |
| 4,586,231 | A * | 5/1986 | Powderley et al. | 29/416 |
| 4,807,576 | A * | 2/1989 | Sonoda et al. | 123/90.57 |
| 4,903,651 | A | 2/1990 | Matsuura et al. | |
| 4,904,230 | A | 2/1990 | Kawashima et al. | |
| 5,007,266 | A * | 4/1991 | Nishiuchi et al. | 72/44 |
| 5,509,385 | A | 4/1996 | Lavieri | |
| 5,515,819 | A | 5/1996 | Groh et al. | |
| 5,551,143 | A | 9/1996 | Saval et al. | |
| 5,642,694 | A * | 7/1997 | Dura et al. | 123/90.43 |
| 5,706,771 | A | 1/1998 | Van Heyningen et al. | |
| 5,706,773 | A * | 1/1998 | Dura et al. | 123/90.51 |
| 5,855,191 | A | 1/1999 | Blowers et al. | |
| 5,901,676 | A | 5/1999 | Edelmayer | |
| 5,918,367 | A | 7/1999 | Todo et al. | |
| 5,964,117 | A * | 10/1999 | Holroyd et al. | 72/258 |
| 6,151,777 | A * | 11/2000 | Sakuraba | 29/890.144 |
| 6,189,199 | B1 * | 2/2001 | Ouchi et al. | 29/557 |
| 6,293,164 | B1 * | 9/2001 | Krause | 74/7 R |
| 6,325,034 | B1 | 12/2001 | Edelmayer | |
| 6,385,847 | B1 * | 5/2002 | Larson et al. | 29/888.451 |
| 6,386,421 | B1 | 5/2002 | Anderson et al. | |
| 6,578,535 | B2 * | 6/2003 | Spath et al. | 123/90.16 |
| 6,735,997 | B2 | 5/2004 | Rosenberger et al. | |
| 6,871,622 | B2 | 3/2005 | Mandal et al. | |
| 6,941,915 | B1 | 9/2005 | Masello et al. | |
| 6,964,251 | B2 | 11/2005 | Mandal et al. | |
| 7,013,857 | B2 | 3/2006 | Williams et al. | |
| 7,025,025 | B2 | 4/2006 | Mandal et al. | |
| 7,028,654 | B2 | 4/2006 | Mandal et al. | |
| 7,032,553 | B2 | 4/2006 | Williams et al. | |
| 7,047,925 | B2 | 5/2006 | Hendriksma et al. | |
| 7,069,891 | B2 | 7/2006 | Mandal et al. | |
| 7,128,034 | B2 | 10/2006 | Mandal et al. | |
| 7,191,745 | B2 | 3/2007 | Mandal et al. | |
| 7,207,302 | B2 | 4/2007 | Williams et al. | |
| 7,273,026 | B2 | 9/2007 | Mandal et al. | |
| 7,281,329 | B2 | 10/2007 | Mandal et al. | |
| 7,284,520 | B2 | 10/2007 | Mandal et al. | |
| 7,293,540 | B2 | 11/2007 | Mandal et al. | |
| 7,322,324 | B2 | 1/2008 | Hara et al. | |
| 7,350,491 | B2 | 4/2008 | Stretch et al. | |
| 8,042,270 | B2 * | 10/2011 | Otake et al. | 29/890.144 |
| 8,490,590 | B2 * | 7/2013 | Kubota et al. | 123/90.55 |
| 8,522,434 | B2 * | 9/2013 | Yoshimura | 29/888.45 |
| 8,555,842 | B2 * | 10/2013 | Janowiak | 123/90.52 |
| 8,752,270 | B2 * | 6/2014 | Sharrah et al. | 29/527.4 |
| 8,904,845 | B2 * | 12/2014 | Su | 72/358 |
| 9,010,291 | B2 * | 4/2015 | Haga et al. | 123/90.52 |
| 2002/0195072 | A1 * | 12/2002 | Spath et al. | 123/90.16 |
| 2003/0074947 | A1 * | 4/2003 | Rosenberger et al. | 72/356 |
| 2003/0168126 | A1 * | 9/2003 | Oohama et al. | 148/246 |
| 2005/0183686 | A1 | 8/2005 | Fujii et al. | |
| 2006/0013521 | A1 | 1/2006 | Krintzline et al. | |
| 2006/0016405 | A1 | 1/2006 | Harris et al. | |
| 2006/0130795 | A1 * | 6/2006 | Williams et al. | 123/90.48 |
| 2006/0137638 | A1 * | 6/2006 | Hofmann | F01L 1/2405 123/90.43 |
| 2007/0074557 | A1 * | 4/2007 | Takada et al. | 72/370.1 |
| 2007/0157898 | A1 * | 7/2007 | Mandal et al. | 123/90.48 |
| 2007/0175262 | A1 * | 8/2007 | Babej et al. | 72/404 |
| 2007/0193544 | A1 | 8/2007 | Mandal et al. | |
| 2007/0214639 | A1 | 9/2007 | Mandal et al. | |
| 2007/0234989 | A1 * | 10/2007 | Mandal et al. | 123/90.48 |
| 2008/0078769 | A1 * | 4/2008 | Crunkleton et al. | 220/560.04 |
| 2008/0277034 | A1 | 11/2008 | Roth | |
| 2009/0013531 | A1 * | 1/2009 | Heraldo et al. | 29/888.04 |
| 2009/0044775 | A1 | 2/2009 | Tallio et al. | |
| 2009/0194050 | A1 * | 8/2009 | Sakurai et al. | 123/90.39 |
| 2010/0071649 | A1 | 3/2010 | Janowiak | |
| 2011/0215271 | A1 * | 9/2011 | Voss et al. | 251/129.15 |
| 2013/0306016 | A1 * | 11/2013 | Kato | 123/90.45 |
| 2013/0319358 | A1 * | 12/2013 | Schnell et al. | 123/90.55 |
| 2014/0230768 | A1 * | 8/2014 | Haga et al. | 123/90.46 |
| 2014/0366827 | A1 * | 12/2014 | Nunami et al. | 123/90.46 |
| 2015/0053672 | A9 * | 2/2015 | Wnek et al. | 219/730 |

FOREIGN PATENT DOCUMENTS

| | | | |
|---|---|---|---|
| DE | 19932346 | A | 1/2001 |
| DE | 102004032240 | A | 2/2006 |
| EP | 1619359 | A | 1/2006 |
| GB | 2112896 | A | 7/1983 |
| GB | 2185549 | A | 7/1987 |
| JP | S5888412 | A | 5/1983 |
| JP | S5929712 | A | 2/1984 |
| JP | S59209440 | A | 11/1984 |
| JP | 63-299840 | | 12/1988 |
| JP | H0126007 | B2 | 5/1989 |
| JP | 02-095706 | | 4/1990 |
| JP | 04-159029 | | 6/1992 |
| JP | 06-079394 | | 3/1994 |
| JP | H06330711 | A | 11/1994 |
| JP | 07-148545 | | 6/1995 |
| JP | 09-103838 | | 4/1997 |
| JP | 2000-071047 | | 3/2000 |
| JP | 2004211585 | A | 7/2004 |
| JP | 2008-213040 | | 9/2008 |

OTHER PUBLICATIONS

International Search Report and Written Opinion for International Patent App. No. PCT/IB2009/007017 dated Jan. 4, 2010.

British Search Report for British Application No. GB1207977.8 dated Aug. 6, 2012.

Chinese Office Action for Chinese Patent Application No. 200910176624.8 dated Sep. 29, 2013 and English translation thereof.

European Search Report for European Application No. 11165519.7 dated Aug. 22, 2011.

Japanese Office Action for Japanese Patent Application No. 2011-528450 dated Aug. 14, 2013 and English translation thereof.

* cited by examiner

CUTOFF

1st

2nd

3rd

4th

5th

BALL PLUNGER FOR USE IN A HYDRAULIC LASH ADJUSTER AND METHOD OF MAKING SAME

CROSS REFERENCE TO RELATED APPLICATIONS

This application is a divisional of U.S. patent application Ser. No. 12/235,919, filed on Sep. 23, 2008. The disclosure of the parent application is incorporated by reference herein in its entirety.

FIELD OF THE INVENTION

The present disclosure is directed to a ball plunger for use in a hydraulic lash adjuster and a method of manufacturing the ball plunger.

BACKGROUND

Hydraulic lash adjusters (also sometimes referred to as "lifters") for internal combustion engines have been in use for many years to eliminate clearance (or "lash") between engine valve train components under varying operating conditions, in order to maintain efficiency and to reduce noise and wear in the valve train. Hydraulic lash adjuster operate on the principle of transmitting the energy of the valve actuating cam through hydraulic fluid trapped in a pressure chamber under a plunger. In a Type II valve train, the plunger is known as a "ball plunger" because it has a ball-shaped portion at one end and a seat surface at its other end. During each operation of the cam, as the length of the valve actuating components varies as a result of temperature changes and wear, small quantities of hydraulic fluid are permitted to enter the pressure chamber, or escape therefrom, thus effecting an adjustment in the position of the ball plunger, and consequently adjusting the effective total length of the valve train.

As is known in the art, ball plungers have been initially made in cold-forming machines and then machined to achieve a desired final shape. However, machining processes are time consuming and add to the cost of the finished ball plunger. There are continual efforts to improve upon the processes to manufacture ball plungers, particularly to reduce the machining time and costs associated therewith.

SUMMARY

In one embodiment, a method of cold-forming a ball plunger blank is provided. The method includes the steps of providing a slug having first and second ends, backward extruding the slug at its first end to form a cavity that is defined by a wall, forming a generally ball-shaped outer surface at the second end of the slug to final dimensions; and upsetting at least a portion of the wall to form a shoulder that at least partially closes the cavity and defines a ball seat surface to its final dimensions.

In an additional embodiment, a method of cold-forming a ball plunger blank using a cold-forming machine having a cutoff station and five forming stations is provided. At the cutoff station, the method includes shearing wire to a desired length to form a slug having first and second ends. At the first forming station, the method includes squaring the first and second ends of the slug and forming an indentation in the first end of the slug. At the second forming station, the method includes backward extruding the slug at its first end to form a first bore that is defined by a tubular wall and forming a generally ball-shaped surface to near final dimensions. At the third forming station, the method includes backward extruding the slug through its first end to form a second bore in the slug having a smaller diameter than the first bore. At the fourth forming station, the method includes upsetting at least a portion of the tubular wall to form a shoulder that at least partially closes the first bore and defines a ball seat surface to near final dimensions. At the fifth forming station, the method includes coining the shoulder to form the ball seat surface to final dimensions.

In another embodiment, a method of manufacturing a finished ball plunger for use in a lash adjuster assembly is provided. The method includes the steps of cold-forming a ball plunger blank having a longitudinal axis to near net shape and machining the ball plunger blank to complete the finished ball plunger. The cold-forming step includes the steps of providing a slug having first and second ends, backward extruding the slug at its first end to form a body portion having a cavity disposed therein that is defined by a wall, forming a ball portion adjacent the second end of the slug, the ball portion including a generally ball-shaped surface sized to its final dimensions, and upsetting at least a portion of the wall to form a shoulder that at least partially closes the cavity and defines a ball seat surface sized to its final dimensions.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1A:
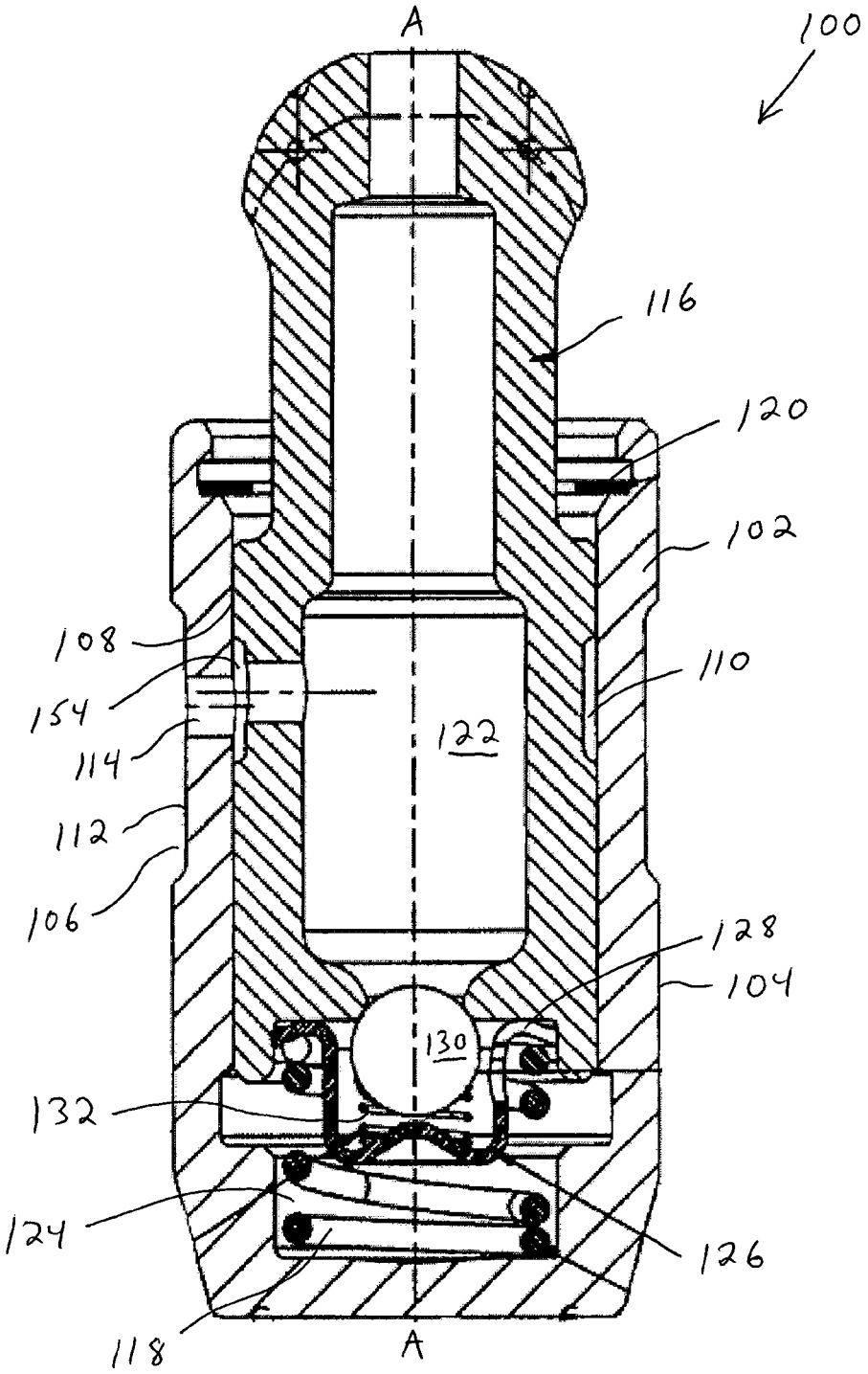
FIG. 1A illustrates a cross-sectional view of an exemplary hydraulic lash adjuster 100.

Certain terminology will be used in the foregoing description for convenience in reference only and will not be limiting. The terms "upward," "downward," "upper," and "lower" will be understood to have their normal meanings and will refer to those directions as the drawing figures are normally viewed. All foregoing terms mentioned above include the normal derivative and equivalents thereof.

The present application is directed to a ball plunger for use in a hydraulic lash adjuster. The ball plunger is of a one-piece construction that is cold-formed to near net shape, requiring a reduced amount of machining to complete the finished part as compared to prior art ball plungers.

FIG. 1A illustrates a cross-sectional view of an exemplary hydraulic lash adjuster 100. The hydraulic lash adjuster 100, which is of the Type II valve train variety, is shown by way of example only and it will be appreciated that the ball plunger employed therein can be used in any configuration of a hydraulic lash adjuster and is not limited to the configuration of the hydraulic lash adjuster 100 illustrated in FIG. 1A. The general structure and operation of the hydraulic lash adjuster 100 shown in FIG. 1A is known to those skilled in the art, and will therefore be described in summary fashion.

As shown in FIG. 1A, the hydraulic lash adjuster 100 includes a body 102 that is configured to be disposed within a mating bore (not shown) in an engine cylinder head (not shown). The body 102 includes a longitudinal axis A, a first generally cylindrical exterior surface 104 having an outwardly facing groove 106, and an interior surface 108 that defines a blind bore 110. The groove 106 is at least partially defined by a second generally cylindrical exterior surface 112 that has an outer diameter that is less than the outer diameter of the first cylindrical exterior surface 104. Extending radially between the first cylindrical exterior surface 104 and the second cylindrical exterior surface 112 is a fluid port 114 that provides fluid communication between the groove 106 and the blind bore 110.

The hydraulic lash adjuster 100 also includes a ball plunger 116 disposed in the blind bore 110. The ball plunger 116, which will be discussed in more detail below, is configured for reciprocal movement relative to the body 102 along the longitudinal axis A. A plunger spring 118 is disposed within the blind bore 104 underneath the ball plunger 116 and is configured to bias the ball plunger 116 in an upward direction relative to the body 102. The plunger spring 118 acts at all times to elevate the ball plunger 116 to maintain its engagement with the hemispherical concave surface (not shown) of a rocker arm (not shown). To limit outward movement of the ball plunger 116 relative to the body 102 and retain the ball plunger 116 within to the body 102, a retaining member 120, such as a retaining ring or washer, is provided adjacent the upper portion of the body 102.

With continued reference to FIG. 1A, the ball plunger 116 itself defines a low pressure fluid chamber 122, while the body 102 and the lower portion of the ball plunger 116 cooperate with each other to define a high pressure fluid chamber 124 within the blind bore 104 of the body 102. To control fluid flow between the low fluid pressure chamber 122 and the high pressure fluid chamber 124, the hydraulic lash adjuster 100 includes a check valve assembly 126 positioned between the plunger spring 118 and the lower portion of the ball plunger 116. The check valve assembly 126 functions to either permit fluid communication, or to block fluid communication, between the low pressure fluid chamber 122 and the high pressure fluid chamber 124, in response to the pressure differential between the two fluid chambers 122, 124.

As shown in FIG. 1A, the check valve assembly 126 includes a retainer 128 that is in engagement with a lower portion of the ball plunger 116, a check ball 130, and a check ball spring 132 that is disposed between the retainer 128 and the check ball 130. The check ball spring 132 is configured to bias the check ball 130 in an upwards direction towards the ball plunger 116, and is therefore commonly referred to by those skilled in the art as a "normally biased closed" check valve assembly.

Figure 1B:
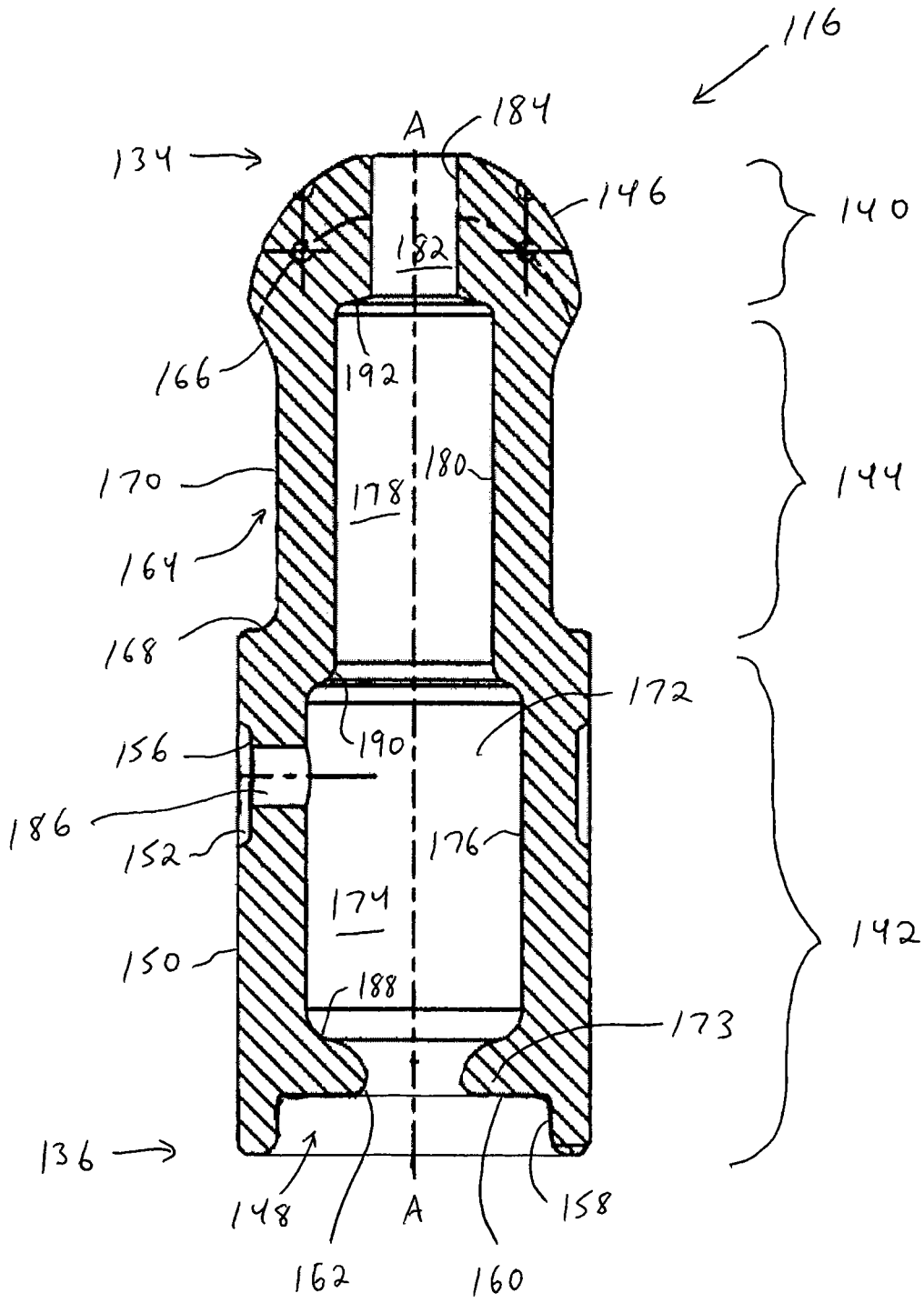
FIG. 1B illustrates a detailed cross-sectional view of one embodiment of a ball plunger 116 for use in the exemplary hydraulic lash adjuster 100.

Illustrated in FIG. 1B is a detailed cross-sectional view of the ball plunger 116 employed in the exemplary hydraulic lash adjuster 100 illustrated in FIG. 1A. It will be appreciated that the ball plunger 116 illustrated in FIGS. 1A and 1B is shown by way of example only and is not limited to the configuration shown in these drawings.

With reference to FIG. 1B, the ball plunger 116 is a generally tubular member having a first end 134 that extends to a second end 136 along a longitudinal axis A, a ball portion 140 adjacent to the first end 134, a body portion 142 adjacent to the second end 136, and a stem portion 144 disposed between the ball portion 140 and the body portion 142. The ball portion 140 of the ball plunger 116 includes a generally ball-shaped or hemispherical outer surface 146, which is configured to engage and pivot about the generally hemispherical concave surface (not shown) of a rocker arm (not shown).

The body portion 142 of the ball plunger 116 includes a counterbore 148 configured to receive the check valve assembly 126, a first generally cylindrical exterior surface 150, and a radially outward facing groove 152 formed in the cylindrical exterior surface 150. The groove 152 cooperates with the interior surface 108 of the body 102 to form a fluid collector channel 154 (see FIG. 1A) and is at least partially defined by a second generally cylindrical exterior surface 156 that has an outer diameter that is less than the outer diameter of the first cylindrical exterior surface 150.

With continued reference to FIG. 1B, the counterbore 148 is defined by a generally cylindrical interior surface 158, a flat annular surface 160 that is generally perpendicular to the axis A and extends from the cylindrical interior surface 158, and a rounded annular surface 162 that extends from the flat annular surface 160. The flat annular surface 160 is sized to receive the retainer 128 of the check valve assembly 126 and will sometimes be referred to herein as the "retainer receiving surface 160." The rounded annular surface 162 is sized to receive the check ball 130 of the check valve assembly 126, such that when the check ball 130 engages the rounded annular surface 162, a fluid tight seal is created between the check ball 130 and the rounded annular surface 162 (see FIG. 1A). Hence, the rounded annular surface 162 may also be referred to herein as the "ball seat 162" or the "ball seat surface 162." Although the ball seat surface 162 in the illustrated embodiment of the ball plunger 116 is a rounded annular surface, it will be appreciated that the ball seat surface 162 can be an annular frusto-conical surface, so long as an appropriate fluid tight seal is created between the check ball 130 and the ball seat surface 162.

The stem portion 144 of the ball plunger 116 is defined by a groove 164 that separates the ball portion 140 from the body portion 142 of the ball plunger 116. The groove 164 is at least partially defined by a frusto-conical surface 166 that extends from the hemispherical exterior surface 146 towards the body portion 142, a transition surface 168 that extends from the first cylindrical exterior surface 150 towards the ball portion 140, and a generally cylindrical exterior surface 170 disposed between the frusto-conical surface 166 and the transition surface 168. In the illustrated example, the transition surface 168 includes a frusto-conical surface and a curved surface that is convex with respect to the longitudinal axis A. However, it will be appreciated that the transition surface 168 can include an annular surface that is generally perpendicular to the axis A, a frusto-conical surface, a curved surface that is concave or convex with respect to the longitudinal axis A, or any combination thereof.

With continued reference to FIG. 1B, disposed within the ball plunger 116 between the ball seat surface 162 and the hemispherical exterior surface 146 is an axially extending passage 172. Provided between the passage 172 and the counterbore 148 is a shoulder 173 that includes, among other surfaces, the retainer receiving surface 160 and the ball seat surface 162.

Generally, the passage 172 (which also corresponds to the low pressure fluid chamber 122 as shown in FIG. 1A) includes a first axially extending bore 174 defined by a first generally cylindrical interior surface 176 having a first diameter, a second axially extending bore 178 defined by a second generally cylindrical interior surface 180 having a second diameter that is less than the first diameter of the first cylindrical interior surface 176, and a third axially extending bore 182 defined by a third generally cylindrical interior surface 184 having a third diameter that is less than the second diameter of the second cylindrical interior surface 180. Extending radially between the first cylindrical interior surface 176 and the second cylindrical exterior surface 156 is a plunger fluid port 186 that provides fluid communication between the groove 152 and the first bore 174.

The passage 172 is also defined by three transition surfaces—a first transition surface 188 that transitions the ball seat surface 162 to the first cylindrical interior surface 176, a second transition surface 190 that transitions the first cylindrical interior surface 176 to the second cylindrical interior surface 180, and a third transition surface 192 that transitions the second cylindrical interior surface 180 to the third cylindrical interior surface 184. It will be appreciated that each of these transition surfaces can include an annular surface that is generally perpendicular to the axis A, a frusto-conical surface, a curved surface that is concave or convex with respect to the longitudinal axis A, or any combination thereof.

Figure 2:
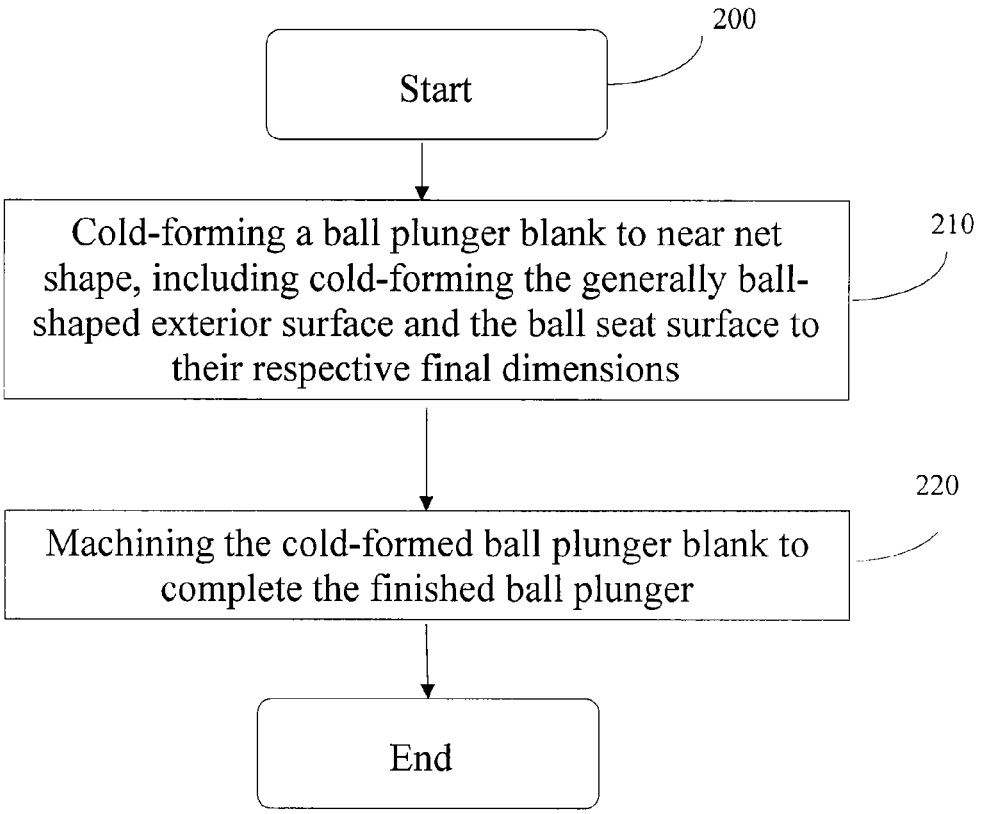
FIG. 2 illustrates an example method 200 of producing the ball plunger 116 described above and illustrated in FIGS. 1A and 1B.

Illustrated in FIG. 2 is an example method 200 of producing the ball plunger 116 described above and illustrated in FIGS. 1A and 1B. As shown in FIG. 2, the method 200 includes two general steps—i) cold-forming a ball plunger blank to near net shape, including cold-forming the generally ball-shaped outer surface 146 and the ball seat surface 162 to their respective final dimensions (step 210) and ii) machining the cold-formed ball plunger blank to complete the finished ball plunger 116 (step 220). As used herein, the term "cold-forming" and its derivatives, is intended to encompass what is known in the art as "cold forging," "cold heading," and "deep drawing." As used herein, the term "machining" means the use of a chucking machine, drilling machine, turning machine, grinding machine, or broaching machine to remove material.

Figures 3, 4A, 4B, 4C, 4D, 4E, 4F:
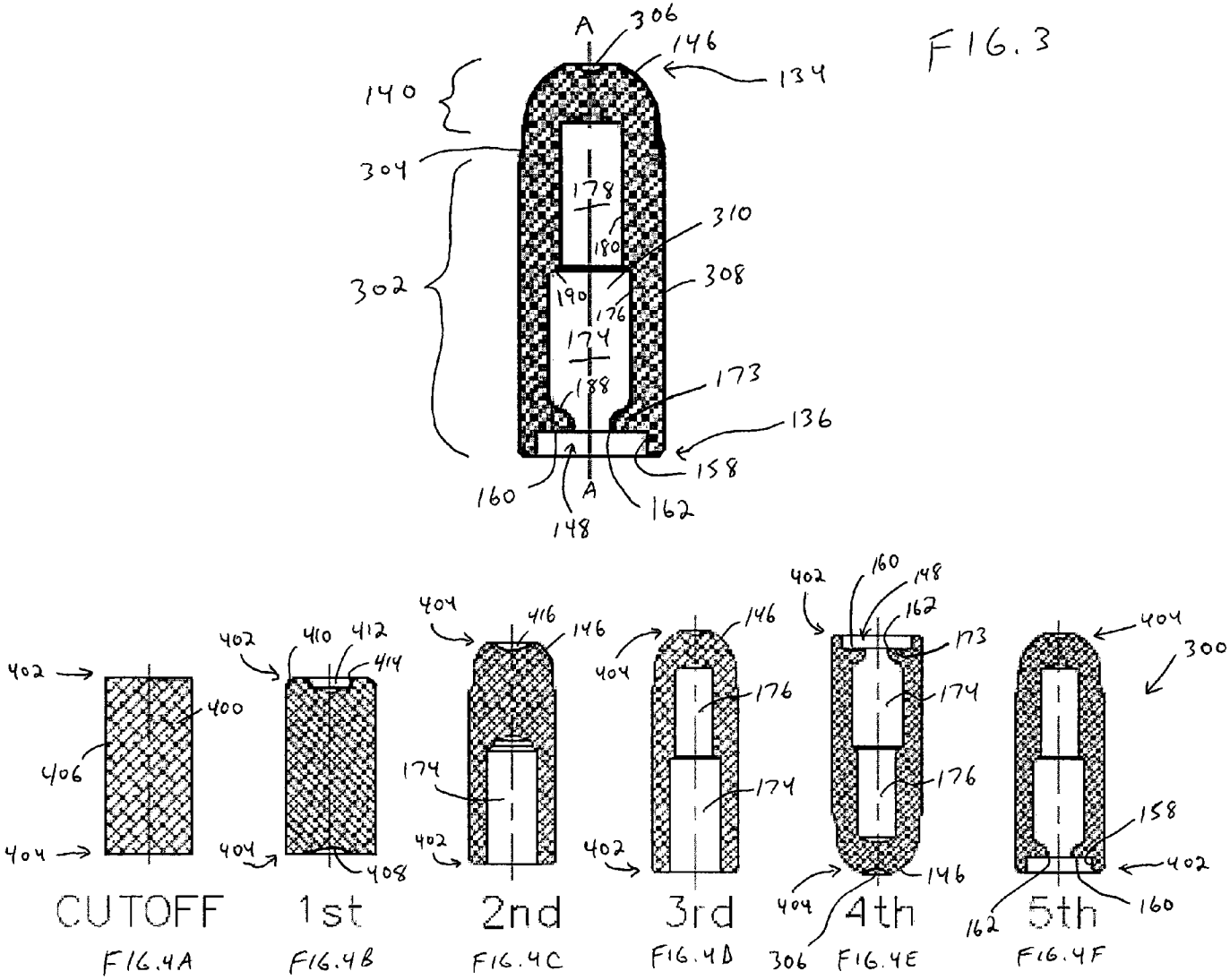
FIG. 3 illustrates a cross-sectional view of one embodiment of a cold-formed ball plunger blank 300 following the cold-forming step (step 210) described in FIG. 2.
FIGS. 4A-4F illustrates an exemplary cold-forming, five station slug progression sequence that can be used to form the cold-formed ball plunger blank 300.

Illustrated in FIG. 3 is a cross-sectional view of one embodiment of a cold-formed ball plunger blank 300 that is the result of the cold-forming step (step 210) described above. As shown in FIG. 3, the cold-formed ball plunger blank 300 is near net shape as compared to the finished ball plunger 116. For consistency purposes, structural features that are common between the cold-formed ball plunger blank 300 and the finished ball plunger 116 will be indicated with the same reference numerals, while different structural features will be indicated with new reference numerals.

As shown in FIG. 3, the cold-formed ball plunger blank 300 includes a generally cup-shaped member having a first end 134 extending toward a second end 136 along a longitudinal axis A, a ball portion 140 adjacent the first end 134, an extended body portion 302 adjacent the second end 136, and a transition surface 304 separating the ball portion 140 from the extended body portion 302. The ball portion 140 includes a generally ball-shaped or hemispherical outer surface 146 and a dimple or indentation 306 extending therefrom. In the illustrated embodiment, the transition surface 304 includes a frusto-conical surface. However, it will be appreciated that the transition surface 304 can include an annular surface that is generally perpendicular to the axis A, a frusto-conical surface, a curved surface that is concave or convex with respect to the longitudinal axis A, or any combination thereof.

The extended body portion 302 of the cold-formed ball plunger blank 300 includes a counterbore 148 and a generally cylindrical exterior surface 308. The counterbore 148 is defined by a generally cylindrical interior surface 158, a flat annular surface 160 that is generally perpendicular to the axis A and extends from the cylindrical interior surface 158 (also referred to as the "retainer receiving surface 160"), and a rounded annular surface 162 (also referred to as the "ball seat 162" or the "ball seat surface 162") that extends from the retainer receiving surface 160.

With continued reference to FIG. 3, disposed within the cold-formed ball plunger blank 300 is an axially extending bore or cavity 310 extending from the ball seat surface 162 towards the ball portion 140. Provided between the cavity 310 and the counterbore 148 is a shoulder 173 that includes, among other surfaces, the retainer receiving surface 160 and the ball seat surface 162.

Generally, the cavity 310 includes a first bore 174 defined by a first generally cylindrical interior surface 176 having a first diameter and a second bore 178 defined by a second generally cylindrical interior surface 180 having a second diameter that is less than the first diameter of the first cylindrical interior surface 176.

The cavity 310 is also defined by two transition surfaces—a first transition surface 188 that transitions the ball seat surface 162 to the first cylindrical interior surface 176 and a second transition surface 190 that transitions the first cylindrical interior surface 176 to the second cylindrical interior surface 180. It will be appreciated that each of these transition surfaces can include an annular surface that is generally perpendicular to the axis A, a frusto-conical surface, a curved surface that is concave or convex with respect to the longitudinal axis A, or any combination thereof.

The cold-formed ball plunger blank 300 can be formed in a variety of cold-forming machines. Suitable examples of cold-forming machines that can be used to form the cold-formed ball plunger blank 300 include Waterbury and National Machinery cold-forming machines. Generally, cold-forming machines include a cut-off station for cutting metal wire to a desired length to provide an initial workpiece (also known as a "slug") and multiple progressive forming stations that include multiple spaced-apart die sections and a reciprocating gate having multiple punch sections, each of which cooperates with a respective die section to form a die cavity. A conventional transfer mechanism moves the slug in successive steps from the cut-off station to each of the forming stations in a synchronized fashion and is also capable of rotating the slug 180 degrees as it is being transferred from one station to another. As cold-forming machines are well known in the art, no further description is necessary.

In one embodiment, the cold-formed ball plunger blank 300 is formed in a five station, cold-forming machine (not shown). It will, however, be appreciated that the cold-formed ball plunger blank 300 can be produced in a different number of forming stations.

Illustrated in FIGS. 4A-4E is an exemplary cold-forming, five station slug progression sequence that can be used to form the cold-formed ball plunger blank 300. Each figure represents the state of the slug at an end-of-stroke tool position. It will be appreciated that this slug progression sequence is merely one example of a cold-forming slug progression sequence and that other slug progression sequences are possible.

The exemplary slug progression sequence begins with shearing wire to a desired length at the cut-off station to provide an initial slug 400, which will be described with reference to a first end 402, a second end 404, and a cylindrical surface 406 that extends therebetween as shown in FIG. 4A. At this stage, the ends of the slug 400 have irregularities or unevenness inherent in the shearing process. The slug 400 is then transferred to the first forming station where its first end 402 faces the die section and its second end 404 faces the punch section.

At the first forming station, the slug 400 is squared and a slight indentation 408 is formed in the second end 404 at the punch section of the cold-forming machine as shown in FIG. 4B. At the die section of the cold-forming machine, a chamfer 410 is simultaneously formed between the first end 402 and the cylindrical surface 406 of the slug 400. Additionally, at the die section, a deeper indentation 412 is formed in the first end 402 of the slug 400 along with a chamfer 414 formed between the indentation 412 and the first end 402. The indentation 412 serves to properly center and guide the punch from the second forming station, which will be described in further detail below. The slug 400 is then rotated 180 degrees and transferred to the second forming station where its first end 402 faces the punch section and its second end 404 faces the die section.

At the second forming station, the first bore 174 is extruded through the first end 402 of the slug 400 to near final dimensions at the punch section of the cold-forming machine as shown in FIG. 4C. Simultaneously, at the die section of the cold-forming machine, the generally hemispherical surface 146 is beginning to be formed at the second end 404 of the slug 400. Additionally, a slight indentation 416 is formed in the second end 404 of the slug 400. The indentation 416 serves to properly center and guide the punch from the fourth forming station, which will be described in further detail below. The slug 400 is then transferred to the third forming station where its second end 404 faces the punch section and its first end 402 faces the die section.

At the third forming station, the second bore 176, having a diameter less than the first bore 174, is backward extruded at the first end 402 of the slug 400 to near final dimensions at the punch section of the cold-forming machine as shown in FIG. 4D. Simultaneously, at the die section of the cold-forming machine, the hemispherical surface 146 is formed at the second end 404 of the slug 400 to near final dimensions. The slug 400 is then rotated 180 degrees and transferred to the fourth forming station where its second end 404 faces the punch section and its first end 402 faces the die section.

At the fourth forming station, the hemispherical surface 146 is formed to near final dimensions and the dimple 306 is formed in the center-point of the hemispherical surface 146 by the punch section of the cold-forming machine as shown in FIG. 4E. Simultaneously, at the die section of the cold-forming machine, a counterbore 148, having a diameter greater than the first bore 174, is formed in the second end 404 of the slug 400. Due to this diametrical difference, the die that forms the counterbore 148 upsets the wall defining the first bore 174 and thereby forms the shoulder 173 that defines the retainer receiving surface 160 and the ball seat surface 162 to near final dimensions. The slug 400 is then rotated 180 degrees and transferred to the fifth forming station where its first end 402 faces the punch section and its second end 404 faces the die section.

At the fifth forming station, as shown in FIG. 4F, the slug 400 is formed to its final dimensions, including overall length and the hemispherical surface 146 being formed to its final dimensions. Also, the cylindrical interior surface 158, the retainer receiving surface 160, and the ball seat surface 162 are coined to their respective final dimensions by the punch section of the cold-forming machine. At the conclusion of the fifth forming station, the cold-formed ball plunger blank 300 is completed and includes all of the structural features shown in FIG. 3.

As discussed above, the cold-formed ball plunger blank 300 includes all of the structural features of the finished ball plunger 116 described above and illustrated in FIGS. 1A and 1B, with the exception of several structural features. To complete the method 200 of producing the finished ball plunger 116 described above and illustrated in FIGS. 1A and 1B, the cold-formed ball plunger blank 300 is machined to form the remaining structural features as discussed above and shown in FIG. 2.

Figure 5:
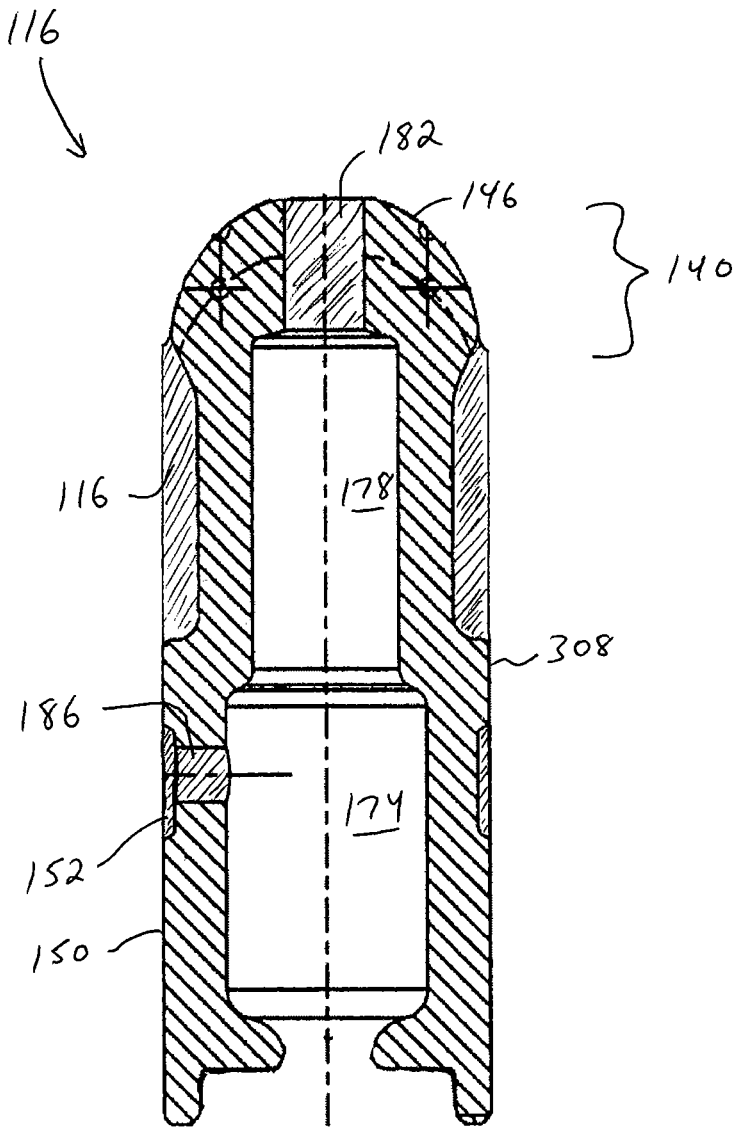
FIG. 5 illustrates a cross-sectional view of the finished ball plunger 116 following the machining step (step 220) described in FIG. 2.

The machining step (step 220) will be discussed with reference to FIG. 5 where the shaded areas of the finished ball plunger 116 represent the material removed from the cold-formed ball plunger blank 300 as a result of the machining step. As shown in FIG. 5, the groove 164 is machined into the extended body portion 302 and a portion of the hemispherical surface 146 and the groove 152 is machined into the first cylindrical exterior surface 150. Additionally, the third bore 182 is drilled into the ball portion 140, such that it communicates with the second bore 178, and the plunger fluid port 186 is drilled into the body portion 142 such that it communicates with the first bore 174. It will be appreciated that these machining operations can be performed one at a time, in combination with one or more other machining operations, or all together in any sequence.

Unlike prior art ball plungers, the ball plunger 116 described above is cold formed to near net shape (including the cold formation to final dimensions of the ball portion 140 and the ball seat surface 162), thereby reducing the machine time to complete a finished ball plunger and thus reducing manufacturing cost of the finished ball plunger. Additionally, when compared to plunger designs that require the use of a seat insert and seal, these parts along with the associated assembly time and costs are eliminated.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about X to Y is intended to mean from about X to about Y, where X and Y are the specified values.

While the present application illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

The invention claimed is:

1. A method of cold-forming a ball plunger blank comprising the steps of:

providing a slug having first and second ends, the first end configured to receive a check valve assembly, the second end configured to engage a rocker arm;

backward extruding the slug at the first end to form a bore having an axial length and a first diameter that is defined by a wall, and that extends a length to a terminal end at the slug;

forming a generally ball-shaped outer surface at the second end of the slug;

upsetting at least a portion of the wall to form a counterbore having a second diameter and a shoulder wherein the second diameter is greater than the first diameter and wherein the shoulder only partially closes the bore and defines a ball seat surface to final dimensions wherein the bore remains open along the axial length to the counterbore through an opening defined by the shoulder subsequent to the upsetting;

simultaneously with the upsetting, forming a closed hemispherical surface at the generally ball-shaped outer surface at the second end of the slug to near final dimensions; and forming the closed hemispherical surface to final dimensions.

2. The method of claim 1, wherein the providing a slug includes shearing wire to a desired length to form the slug.

3. The method of claim 1, further comprising squaring the first and second ends of the slug before backward extruding the slug.

4. The method of claim 1, further comprising forming a first indentation in the first end of the slug and a second indentation in the second end of the slug before backward extruding the slug.

5. The method of claim 1, further comprising the forming a dimple in the ball-shaped outer surface.

6. The method of claim 1, wherein the upsetting only a portion of the wall includes inwardly upsetting the portion of the wall to displace wall material and wherein the bore remains open along an entirety of the axial length.

7. The method of claim 1, further comprising forming a chamfer at the second end of the slug prior to forming the generally ball-shaped outer surface at the second end of the slug.

8. A method of cold-forming a ball plunger blank using a cold-forming machine having a cutoff station and five forming stations, the method comprising the steps of:

at the cutoff station, shearing wire to a desired length to form a slug having first and second ends;

at the first forming station, squaring the first and second ends of the slug and forming an indentation in the first end of the slug;

at the second forming station, backward extruding the slug at the first end to form a first bore having a first diameter that is defined by a tubular wall, and forming a generally ball-shaped surface at the second end;

at the third forming station, backward extruding the slug through the first end to form a second bore in the slug having a second diameter that is smaller than the first diameter, wherein the first and second bores extend collectively substantially along a longitudinal length of the slug;

at the fourth forming station, (i) upsetting only a portion of the tubular wall at the first end to form a counterbore having a third diameter and a shoulder, wherein the third diameter is greater than the first diameter and wherein the shoulder only partially closes the first bore and defines a ball seat surface to near final dimensions, wherein the first and second bores are both open to the counterbore through the shoulder subsequent to the upsetting, and (ii) simultaneously with the upsetting, forming a closed hemispherical surface at the generally ball-shaped outer surface at the second end of the slug to near final dimensions; and at the fifth forming station, coining the shoulder to form the ball seat surface and forming the closed hemispherical surface to final dimensions.

9. The method of claim 8, further comprising: at the first station, forming an indentation in the second end of the slug.

10. The method of claim 8, further comprising: at the first station, forming a chamfer at the second end of the slug.

11. The method of claim 8, wherein the upsetting only a portion of the tubular wall includes inwardly upsetting the portion of the tubular wall to displace wall material that forms the shoulder and wherein the first and second bores both remain open along respective lengths thereof.

12. A method of manufacturing a ball plunger for use in a lash adjuster assembly, the method comprising the steps of:

cold-forming a ball plunger blank having a longitudinal axis to near net shape including the steps of:

providing a slug having first and second ends;

backward extruding the slug at the first end to form a body portion having a cavity disposed therein that has a first diameter and is defined by a wall, forming a ball portion at the second end of the slug, the ball portion including a generally ball-shaped surface, and upsetting only a portion of the wall to form a counterbore having a second diameter and a shoulder, wherein the second diameter is greater than the first diameter and wherein the shoulder only partially closes the cavity and defines a ball seat surface sized to final dimensions wherein the cavity is defined exclusively by the slug and remains open to the counterbore through the shoulder subsequent to the upsetting, simultaneously with the upsetting, forming a closed hemispherical surface at the generally ball-shaped outer surface at the second end of the slug to near final dimensions; and subsequent to the upsetting and the forming the closed hemispherical surface, forming the closed hemispherical surface to final dimensions and machining the ball plunger blank to complete the finished ball plunger.

13. The method of claim 12, wherein the machining includes cutting an annular groove in the ball plunger blank to form a stem portion between the ball portion and the body portion.

14. The method of claim 12, wherein the machining includes cutting an annular groove in the body portion of the ball plunger blank.

15. The method of claim 12, wherein the machining includes drilling a hole in the ball portion of the ball plunger blank that is generally coaxial with the longitudinal axis of the ball plunger blank and communicates with the cavity wherein a continuous longitudinal passage is defined through the ball plunger blank from the hole, through the cavity, through an opening defined by the shoulder and to the counterbore.

16. The method of claim 14, wherein the machining includes drilling a hole in the body portion of the ball plunger blank that is located within the annular groove in the body portion, that is oriented generally perpendicular to the longitudinal axis of the ball plunger blank, and that communicates with the cavity.

17. The method of claim 12, wherein the providing a slug includes shearing wire to a desired length to form the slug.

18. The method of claim 12, wherein the cold-forming a ball plunger blank further includes forming a first indentation in the first end of the slug and a second indentation in the second end of the slug before backward extruding the slug.

19. The method of claim 12, wherein the upsetting only a portion of the wall includes inwardly upsetting the portion of the wall to displace wall material that forms the shoulder and defines an opening.

20. The method of claim 12, wherein the cold-forming a ball plunger blank further includes coining the shoulder to form the ball seat surface.

21. A method of cold-forming a ball plunger blank using a cold-forming machine having a cutoff station and five forming stations, the method comprising the steps of:

at the cutoff station, shearing wire to a desired length to form a slug having first and second ends;

at the first forming station, squaring the first and second ends of the slug and forming an indentation in the first end of the slug;

at the second forming station, backward extruding the slug at the first end to form a first bore having a first diameter that is defined by a tubular wall and forming a generally ball-shaped surface;

at the third forming station, backward extruding the slug through the first end to form a second bore in the slug having a second diameter that is smaller than the first diameter;

at the fourth forming station, upsetting the tubular wall at the first end to form a counterbore having a third diameter and a shoulder, wherein the third diameter is greater than the first diameter and wherein the shoulder partially closes the first bore and defines a ball seat surface to near final dimensions, wherein the first and second bores are both open during formation of the counterbore, simultaneously with the upsetting, forming a closed hemispherical surface at the generally ball-shaped outer surface at the second end of the slug to near final dimensions; and at the fifth forming station, coining the shoulder to form the ball seat surface and forming the generally ball-shaped surface to final dimensions.

22. The method of claim 21, further comprising: at the first station, forming an indentation in the second end of the slug.

23. The method of claim 21, further comprising: at the first station, forming a chamfer at the second end of the slug.

24. The method of claim 21, wherein the upsetting the tubular wall includes inwardly upsetting the portion of the tubular wall to displace wall material that forms the shoulder and wherein the first and second bores both remain open along respective lengths thereof during the upsetting.

* * * * *